United States Patent [19]

Kaufmann

[11] 4,164,187

[45] Aug. 14, 1979

[54] MOTORIZED OVERHEAD TROLLEY

[75] Inventor: Karl E. Kaufmann, Wetter, Fed. Rep. of Germany

[73] Assignee: DeMag Aktiengesellschaft, Duisburg, Fed. Rep. of Germany

[21] Appl. No.: 783,609

[22] Filed: Apr. 1, 1977

[30] Foreign Application Priority Data

Apr. 28, 1976 [DE] Fed. Rep. of Germany ..... 2618516

[51] Int. Cl.[2] ..... B61B 3/02; B61C 3/00; B61C 13/06; B61F 11/00

[52] U.S. Cl. ..... 104/93; 104/109; 105/150; 105/156

[58] Field of Search ..... 104/89, 93, 165, 172 BT, 104/109; 105/148, 150, 153, 156, 215 C

[56] References Cited

U.S. PATENT DOCUMENTS

| | | | |
|---|---|---|---|
| 1,725,264 | 8/1929 | Garnet | 105/156 |
| 2,157,650 | 5/1939 | Fildes | 105/215 C |
| 2,302,196 | 11/1942 | Downs et al. | 104/89 X |
| 2,731,922 | 1/1956 | Robb | 105/156 |
| 3,437,314 | 4/1969 | Minor | 105/148 |
| 3,935,822 | 2/1976 | Kaufmann | 105/153 |

FOREIGN PATENT DOCUMENTS

| | | | |
|---|---|---|---|
| 614895 | 12/1948 | United Kingdom | 105/93 |

*Primary Examiner*—Albert J. Makay
*Assistant Examiner*—Howard Beltran
*Attorney, Agent, or Firm*—Mandeville and Schweitzer

[57] ABSTRACT

The invention has reference to an overhead trolley, particularly for tracks in a store, its wheel running on a rail driven by a motor, where actuation of the pivoted auxiliary wheel assembly elevates the trolley to support the driven wheel of the trolley on a support wheel and the auxiliary wheel above a rail of the tracks. The trolley includes an arrangement with an auxiliary wheel, which may be pivoted manually into and out of engagement with the rail surface. Pivoting the auxiliary wheel into engagement with the rail surface has the effect of raising the drive wheel from the rail surface so that a disabled trolley may be pushed out of the way.

9 Claims, 7 Drawing Figures

MOTORIZED OVERHEAD TROLLEY

BACKGROUND AND STATEMENT OF THE INVENTION

A rail system with several overhead trolleys presents the problem that a disturbance in the drive system of one trolley blocks the entire store track, due to the fact that the drive motor prevents any advancement of such trolley. In connection with the trolley according to German Patent DT-OS No. 1 808 210 it was already suggested to connect the driven wheel to the drive via a clutch in order to be able to move the trolley by means of another trolley or by hand after disconnecting its drive motor. The use of a relatively expensive clutch to be employed in those rare cases where the drive must be detached from the wheel running on the rail represents excessive expenditure and is, from an economical point of view, disadvantageous. Also, it requires personnel to reach the trolley in order to disconnect the clutch, which is not always easy. It is, therefore, the object of this invention to design a simple means of facilitating movement of the trolley on the rail should there be any disturbance in the drive system.

This problem is solved by supplying the drive wheel with an auxiliary wheel lifting the drive wheel off the rail. If trouble occurs the auxiliary wheel carries the load of the overhead trolley, while the drive wheel is lifted off the rail and no longer acts as a brake on the trolley, when the trolley is pushed by another force to a branch where it can be removed from the rail system.

In one embodiment of the invention, the auxiliary wheel is arranged on the overhead trolley by means of a hinged or pivotable rocker. The rocker, in folded-down position, rests with a supporting abutment against a supporting stop on the trolley, whereby the auxiliary wheel axle in folded-down rocker or nail engaging position assumes a position beneath the rocker axle, where it is displaced toward the supporting stop to one side of a vertical line going through the rocker axle. When folding down or pivoting the auxiliary wheel, the rocker moves past a dead center due to such displaced arrangemment, so that the rocker is kept in supporting position by the trolley load. When folded up, the rocker rests with a second abutment against a second stop on the trolley. Supporting stop and free stop are faces of a stopping block.

The rocker is provided with a device to prevent unintentional drop from the folded-up position. This device consists of a plate spring resting on the rocker axle, adhering to the rocker and also resting against a support pin. The initial tension of the plate spring is chosen so as to require a force of about 1–2 kp to adjust the rocker. The rocker has an actuating end with actuating lug where a peg of an actuating bar or the like can be inserted from the floor in order to move the rocker up or down.

In the case of a trolley with only one wheel on a rail, the invention further provides that the side opposite the auxiliary wheel is supplied with a support wheel arranged at the trolley in such a manner that a straight line drawn between the lower edges of the folded-down auxiliary wheel and the support wheel runs beneath the lower edge of the drive wheel. The support wheel prevents tilting of the trolley around the drive wheel when pressing down the auxiliary wheel. The support wheel may be attached directly to the trolley or on a supporting bracket extending from the trolley.

With invention, tilting of a trolley running on the rail with only one wheel while pressing down the auxiliary wheel can also be prevented if the trolley is connected accordingly with a support trolley via a linkage. The support trolley supports the overhead trolley in the transport of heavy loads. In order to permit the passing of curves, the linkage is arranged a pivot on a vertical carrier pin on the overhead trolley and on the support trolley.

DETAILED DESCRIPTION OF THE INVENTION

Figure 1:
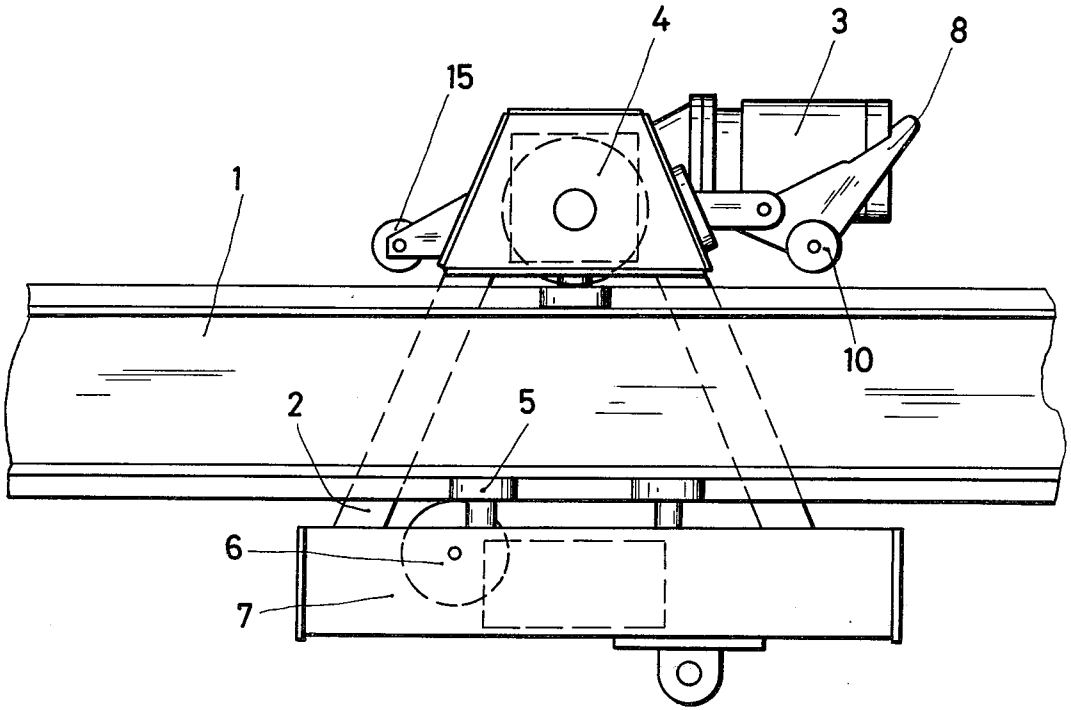
FIG. 1 is a side elevational view of an overhead trolley supported on a rail, and embodying the invention.
Figure 1A:
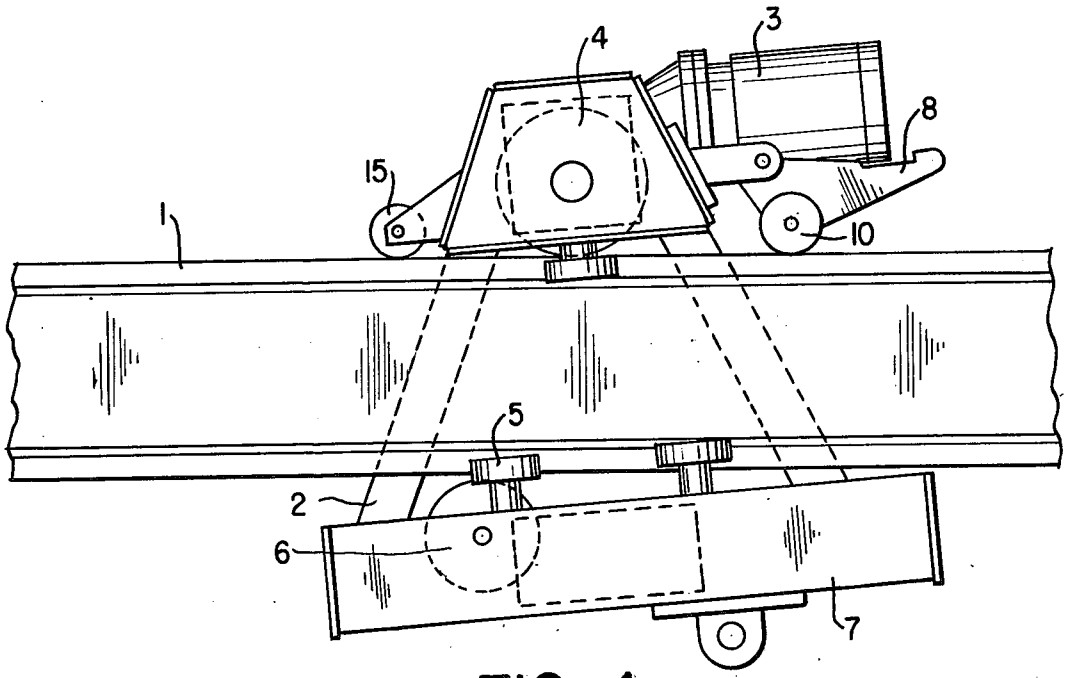
FIGS. 1*a* and 1*b* are views of the apparatus of FIG. 1 in a sequence of positions during the pivoting of the auxiliary wheel into rail engaging position.
Figure 1B:
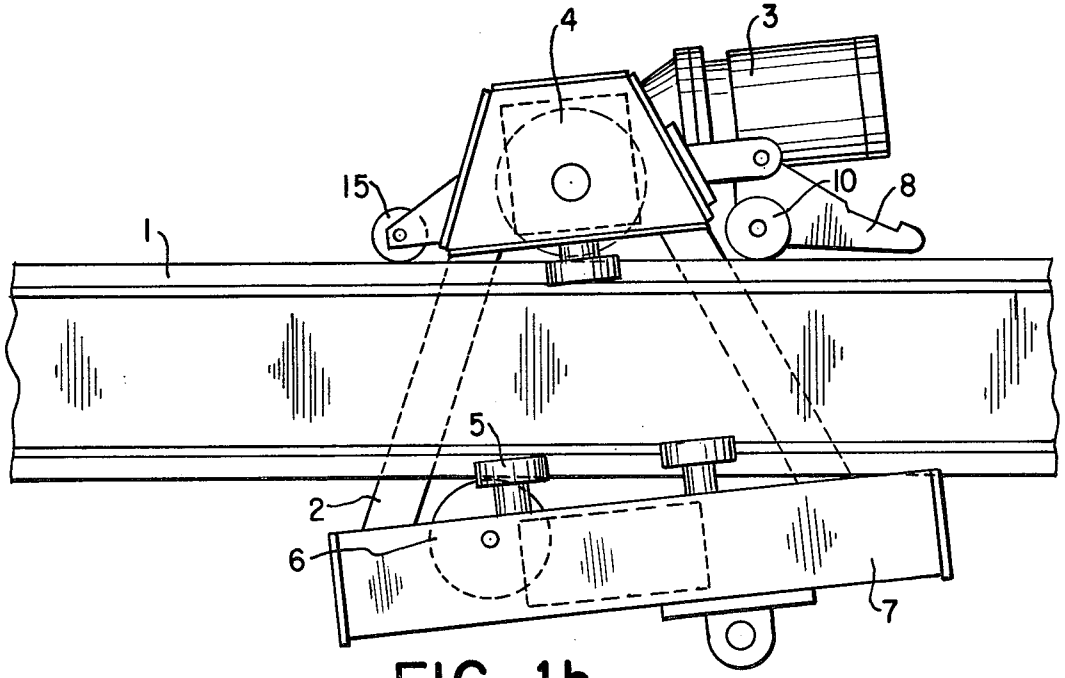

Overhead trolley 2 runs on rail 1 with wheel 4 driven by drive motor 3. On each side of rail 1, overhead trolley 2 is furnished with several guide wheels 5 and, at the bottom, with counter wheel 6, which adheres to rail 1 from below in accordance with the unilateral position of the center of gravity of overhead trolley 2. Overhead trolley 2 is equipped with load carrier 7 on the bottom and, on top, with rocker 8 which folds up, complete with auxiliary wheel 10 which is pressed down on rail 1 by pivoting rocker 8 in case of drive failure, thus causing wheel 4 to lift off rail 1, whereby the overhead trolley is also supported on rail 1 via supporting wheel 15. As can be seen in FIG. 1*a*, in the first pivoting movement of auxiliary wheel 10, the wheel engages the rail surface causing tilting of the trolley body, and further movement past dead center causes the trolley to settle into position supported on wheels 15 and 10 above the rail and stabilized by counterwheel 6 below the rail.

Figure 2:
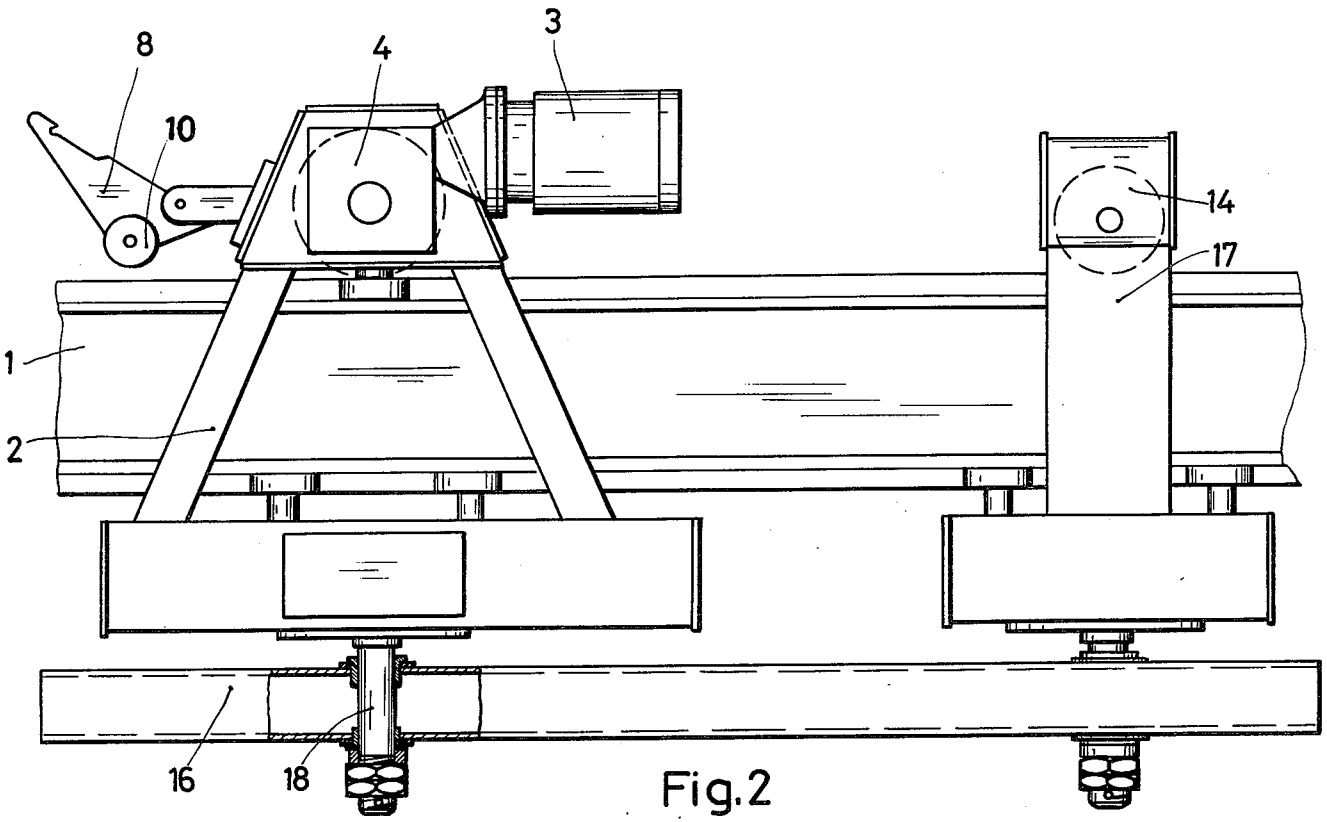
FIG. 2 is a side elevational view of a further embodiment of overhead trolley embodying the invention and including a connected support trolley.
Figure 2A:
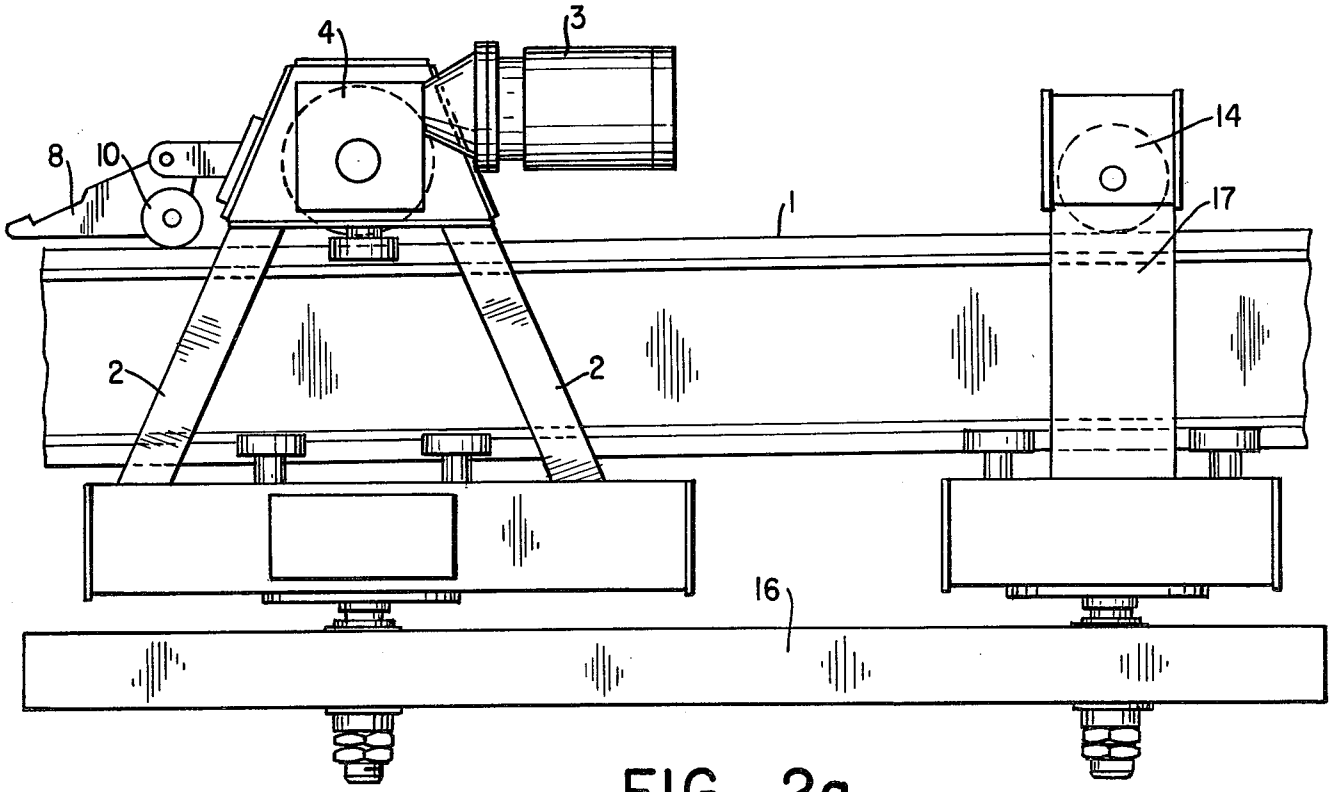
FIG. 2*a* is another view of the apparatus of FIG. 2 showing the auxiliary wheel pivoted into rail engaging position.

In the example shown on FIG. 2, overhead trolley 2 running on rail 1 is connected via carrier pin 18 and linkage 16 with support trolley 17, which rests on rail 1 with wheel 14 which is not driven. In case of failure of drive motor 3, rocker 8 with auxiliary wheel 10 is folded down while wheel 4 of overhead trolley 2 lifts off rail 1, whereby carrier pin 18 and linkage 16 prevent tilting of overhead trolley 2 around wheel 4 shown in FIG. 2*a*.

Figure 3:
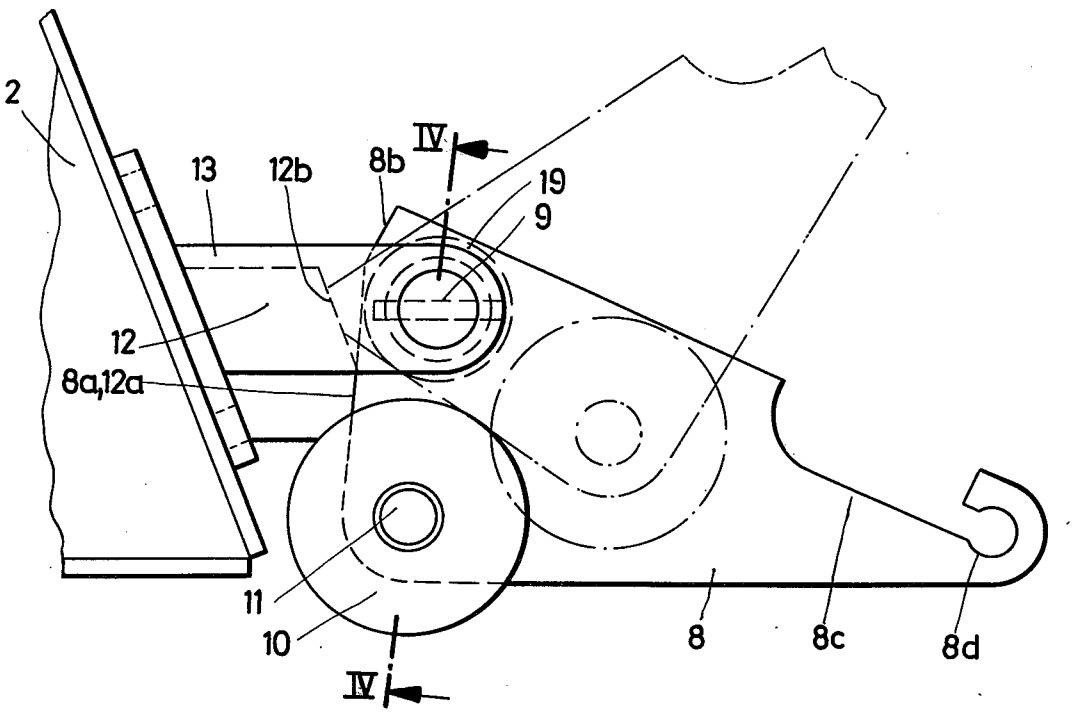
FIG. 3 is an enlarged side elevational view of a portion of the trolley of FIG. 1, and showing details of the pivotal rocker.

FIG. 3 indicates rocker 8 with auxiliary wheel 10 in folded-down position in full lines, and in folded-up position in dot-dash lines. In folded-down position, rocker 8 rests with supporting abutment 8*a* at supporting stop 12*a* of stopping block 12, and in folded-up position with abutment 8*b* at free stop 12*b* of stopping block 12 while it is kept in this position by plate spring 19. Rocker axle 9 of rocker 8 is arranged in pillow block 13 of trolley 2. Axle 11 of auxiliary wheel 10 is located on rocker 8 at the left a vertical plane through of rocker axle 9, so that when raising rocker 8, auxiliary wheel 10 is moved pass dead center, directly beneath rocker axle 9, thus slightly raising overhead trolley 2. The actuating end 8*c* of rocker 8 is furnished with actuating lug 8*d* in which engages an actuating peg of an actuating bar which is not shown.

Figure 4:
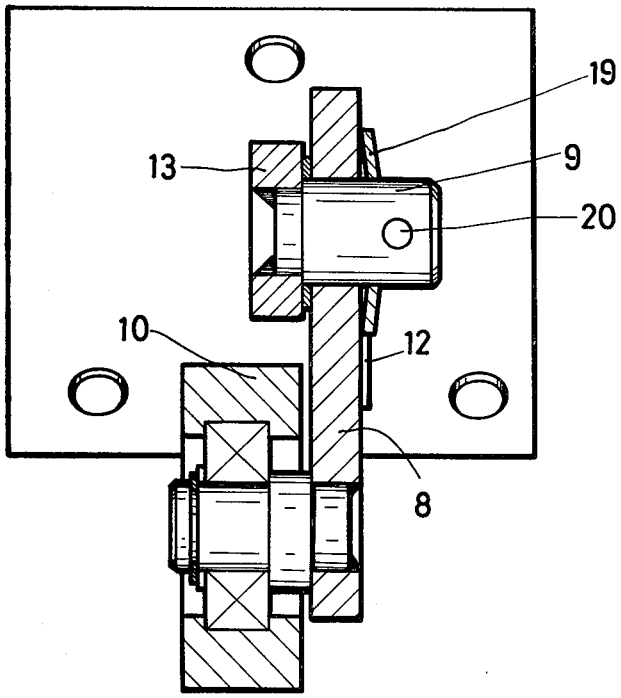
FIG. 4 is a cross section along lines IV—IV of FIG. 3.

FIG. 4 represents a cross section through pillow block 13 with rocker axle 9 for rocker 8 complete with auxiliary wheel 10, resting at stopping block 12. Plate spring 19 to hold up rocker 8 rests against a support pin 20 going through rocker axle 9.

I claim:

1. An overhead trolley comprising (a) a rail;

(b) a trolley body for travel on said rail;

(c) a drive wheel on said trolley body engaging said rail;

(d) a drive motor connected to said drive wheel; the improvement characterized by (e) a rocker arm pivotally mounted on said trolley body;

(f) an auxiliary wheel mounted on said rocker arm;

(g) said auxiliary wheel pivotal on said arm from a position away from said rail to a position engaging said rail;

(h) the pivot axis of said rocker arm being at a distance from said rail less than the pivot axis of said drive wheel;

(i) whereby said rail engaging position of said auxiliary wheel raises said body with said drive wheel away from said rail; and (j) support means on said trolley body and spaced from said auxiliary wheel;

(k) said support means engaging said rail in the raised position of said drive wheel;

(l) whereby the auxiliary wheel and support means hold the drive wheel in elevated position when said auxiliary wheel and support means engage the rail.

2. The apparatus of claim 1, further characterized by (a) an actuating lug integral with said rocker.

3. The apparatus of claim 1, further characterized by said support means including (a) a support wheel on said trolley body at the end thereof opposite said auxiliary wheel;

(b) said support wheel engaging said rail in the raised position of said drive wheel; and (c) a counterwheel on said trolley body, said counterwheel mounted to engage said rail on the side thereof opposite said drive wheel.

4. The apparatus of claim 1, further characterized by (a) a support trolley for engaging said rail; and (b) a linkage connecting said body to said support trolley.

5. The apparatus of claim 4, further characterized by (a) vertical pivot pins connecting said body and said support trolley to said linkage.

6. The apparatus of claim 1, further characterized by (a) cooperating first stops on said body and said rocker when said auxiliary wheel is in engagement with said rail; and (b) the axis of said auxiliary wheel displaced to one side of a vertical plane passing through said rocker axle toward said first stop on said body.

7. The apparatus of claim 6, further characterized by (a) cooperating second stops on said body and said rocker when said auxiliary wheel is out of engagement with said rail.

8. The apparatus of claim 7, further characterized by (a) means between said rocker and said rocker axle preventing free pivoting movement of said rocker on said axle.

9. The apparatus of claim 8, further characterized by (a) a plate spring on said rocker axle; and (b) a support pin for said plate spring, said support pin engaging said rocker axle.

* * * * *